US007383760B1

(12) United States Patent
Phillips et al.

(10) Patent No.: US 7,383,760 B1
(45) Date of Patent: Jun. 10, 2008

(54) BANDOLIERED FLECHETTES AND METHOD FOR MANUFACTURING BANDOLIERED FLECHETTES

(75) Inventors: Charles Morrison Phillips, Zelienople, PA (US); William Harry Rodgers, Butler, PA (US); Michael Wayne Kelley, Sarver, PA (US); Robert Anthony Gagliardi, Butler, PA (US); Regis A. Geibel, Butler, PA (US); Eric R. Clouse, Butler, PA (US)

(73) Assignee: Penn United Technologies, Inc., Cabot, PA (US)

( * ) Notice: Subject to any disclaimer, the term of this patent is extended or adjusted under 35 U.S.C. 154(b) by 465 days.

(21) Appl. No.: 11/206,256

(22) Filed: Aug. 17, 2005

Related U.S. Application Data

(60) Provisional application No. 60/602,480, filed on Aug. 18, 2004.

(51) Int. Cl.
*B21K 21/06* (2006.01)

(52) U.S. Cl. ..... 86/51; 89/34; 89/35.01

(58) Field of Classification Search ..... 89/33.2, 89/33.04, 33.25, 51; 86/34, 35.01
See application file for complete search history.

(56) References Cited

U.S. PATENT DOCUMENTS 3,407,463 A * 10/1968 Boots et al. ..... 86/51
3,580,031 A * 5/1971 Donadio et al. ..... 72/186
3,673,047 A * 6/1972 Buth et al. ..... 156/563
3,766,825 A * 10/1973 Robinson ..... 89/33.04

* cited by examiner

*Primary Examiner*—Troy Chambers
(74) *Attorney, Agent, or Firm*—David C. Jenkins; Eckert Seamans Cherin & Mellott, LLC

(57) ABSTRACT

A method of making flechettes employing the use of a progressive die which forms (a) wire that results in the flechette, and (b) strip material that results in a carrier for the finished flechettes. The carrier, which is a bandolier apparatus, is used for progressing the flechette through the progressive die at various forming stations. After forming of the flechette in the die is complete, the final flechette can be severed from the bandolier, or the flechette can remain intact with the bandolier for post-forming operations, such as coating/finishing. The bandolier is thus a novel approach to transporting the flechettes in both forming and post-forming processing.

11 Claims, 9 Drawing Sheets

BANDOLIERED FLECHETTES AND METHOD FOR MANUFACTURING BANDOLIERED FLECHETTES

CROSS REFERENCE TO RELATED APPLICATIONS

This application claims the benefit of copending U.S. Provisional Application No. 60/602,480, filed Aug. 18, 2004, by the same inventors.

BACKGROUND OF THE INVENTION

The present invention relates to bandoliered flechettes, and to a method for making bandoliered flechettes.

Flechettes are dart-like projectiles that are shaped for aerodynamically stable flight and used as anti-personnel weapons. Each flechette defines a tip at one end that leads the flechette during flight, and fins at the other end that stabilize the flechette during flight. The flechettes are packed into a cylindrical shell, and the entire assembly is fired toward the desired target. The shell explodes near the target and releases the flechettes, which are propelled, tip first, toward and penetrate the target.

Flechettes are commonly produced with a method that employs a modified common nail-making machine. The technology used in nail-making machines has been in existence for many years. This known method of manufacturing flechettes involves supplying the machine with coiled wire, feeding the wire into the modified nail machine, forming the tip and fins, cutting the wire, and expelling the formed flechette as a single, loose-pieced item. There are manufacturing inefficiencies and quality concerns associated with the use of this method. First, the method is quite slow—generally less than 100 parts per minute, per nail machine and, typically, approximately 60 parts per minute. Second, the cost of each part produced is high. Third, the quality of the finished pieces is relatively low. In particular, the use of a modified nail-making machine to make the flechettes occasionally leaves residual slivers of materials, or burrs, on the fins or tips of the flechettes. Burrs are commonly produced by the prior art method of manufacturing due to the fact that this method processes the wire continuously. That is, the flechettes are formed on a single strand of wire, and then are cut to separate them from each other. Thus, the tip and fins of adjacent flechettes are connected together when they are formed on the wire, and the flechettes are separated by cutting the strand between the fins and tip of the adjacent flechettes. It is at the area where this cut is made that the burrs are sometimes produced. This method can produce a hook-shaped burr on the tip of the flechette or a burr on the fins. The burred tip can cause the flechette to be unstable in flight. Flechettes with burred fins are unacceptable because they cannot be packed into the cylindrical shell properly. In either case, the burred flechettes must be either further reworked or discarded, either of which adds to the cost of productions. Finally, certain operations often must be performed on the loose flechettes after they are formed on the wire and separated from each other. The post-forming operations which can occur in the manufacture of flechettes include heat treating, coating or finishing (for example, coating the flechettes with zinc phosphate), and various assembly operations (for example, assembly of flechettes into a cylindrical shell device). These operations often require that the flechettes be arranged in a desired pattern. For example, the operation of assembling the flechettes in a cylindrical shell requires that all the flechettes be so oriented that all the fins point in one direction, and all the tips point in the opposite direction. However, the prior art method of manufacturing yields completed parts in the form of loose pieces that are oriented in different directions. Therefore, the current method does not lend itself easily to the post-formation operations.

Therefore, there is a need for a method for producing flechettes that improves the rate of production, lowers the per piece cost, and improves the quality and consistency of the flechettes, while at the same time facilitating the handling and conveying of the flechettes during post-forming operations.

SUMMARY OF THE INVENTION

The progressive die stock strip disclosed in this application receives raw material for processing in the form of steel wire and steel strip. The wire material is fed into the die and cut into wire segments of a predetermined length, which are subsequently formed into flechettes. The strip material is fed into the die and formed into a carrier or bandolier that transports a plurality of the wire segments through progressive die stations at which various forming operations are performed on the wire segments to form them into flechettes, and then transports them out of the die. The fins of the flechettes can be formed before or after the wire material is cut into wire segments.

The bandolier retains the completely formed flechettes after they have exited the die and can, if desired, convey them to additional stations for post-forming operations. The post-forming operations can include coating and finishing, heat-treating, assembly operations, and cleaning. The bandolier retains each flechette in place with a retention member that has sufficient retention force to hold the flechette in place on the bandolier. The flechettes are evenly spaced and uniformly oriented on the bandolier to facilitate the post-forming operations. The flechettes remain retained on the bandolier by the retention members until they reach the location at which they must be released from the bandolier. Releasing the flechette from the bandolier can be accomplished by applying a small force to overcome the retention member in any number of known ways.

Therefore, the present invention produces flechettes in a way that improves the rate of production, lowers the per piece cost, and improves the quality and consistency of the flechettes, while at the same time facilitating the handling and conveying of the flechettes during post-forming operations.

BRIEF DESCRIPTION OF THE DRAWINGS

The foregoing summary, as well as the following detailed description of the preferred embodiments, will be better understood when read in conjunction with the appended drawing, in which.

DETAILED DESCRIPTION OF THE INVENTION

The appended drawing figures and descriptions of the present invention have been simplified to illustrate elements that are relevant for a clear understanding of the present invention, while eliminating, for purposes of clarity, other elements. Those of ordinary skill in the art will recognize that other elements may be desirable in order to implement the present invention. However, because such elements are well known in the art, and because they do not facilitate a better understanding of the present invention, a discussion of such elements is not provided herein.

In the present Detailed Description of the Invention, the preferred embodiments of the present invention are described in forms that are particularly useful in an actual bandoliered flechette application having a particular configuration. To the extent that this configuration gives a particular size and structural shape to the object, it should be understood that the invention is not limited to embodiment in such form and may have application in manufacturing flechettes of any size, shape, and configuration. Thus, while the present invention is capable of embodiment in many different forms, this detailed description and the accompanying drawing disclose specific forms only as examples of the invention. Those having ordinary skill in the relevant art will be able to adapt the invention to application in other forms not specifically presented herein based upon the present description. It should be understood that the detailed description in this form is only illustrative of the present invention, and that the present invention may be employed with objects of other shapes and configurations that are not specifically described herein.

Figure 1:
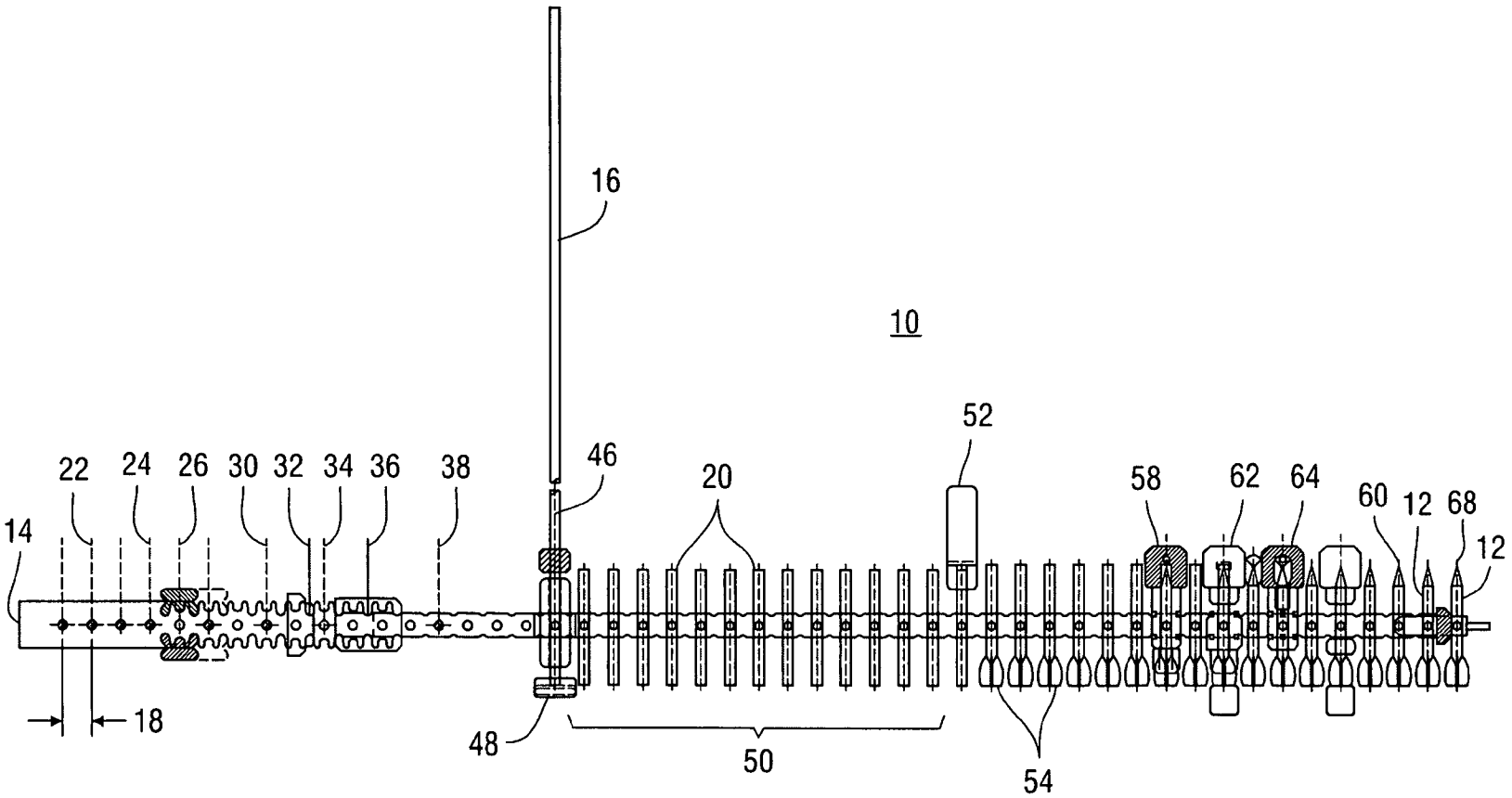
FIG. 1 is a top plan view of a progressive die stock strip and bandoliered flechettes provided by the present invention.
Figure 2A:
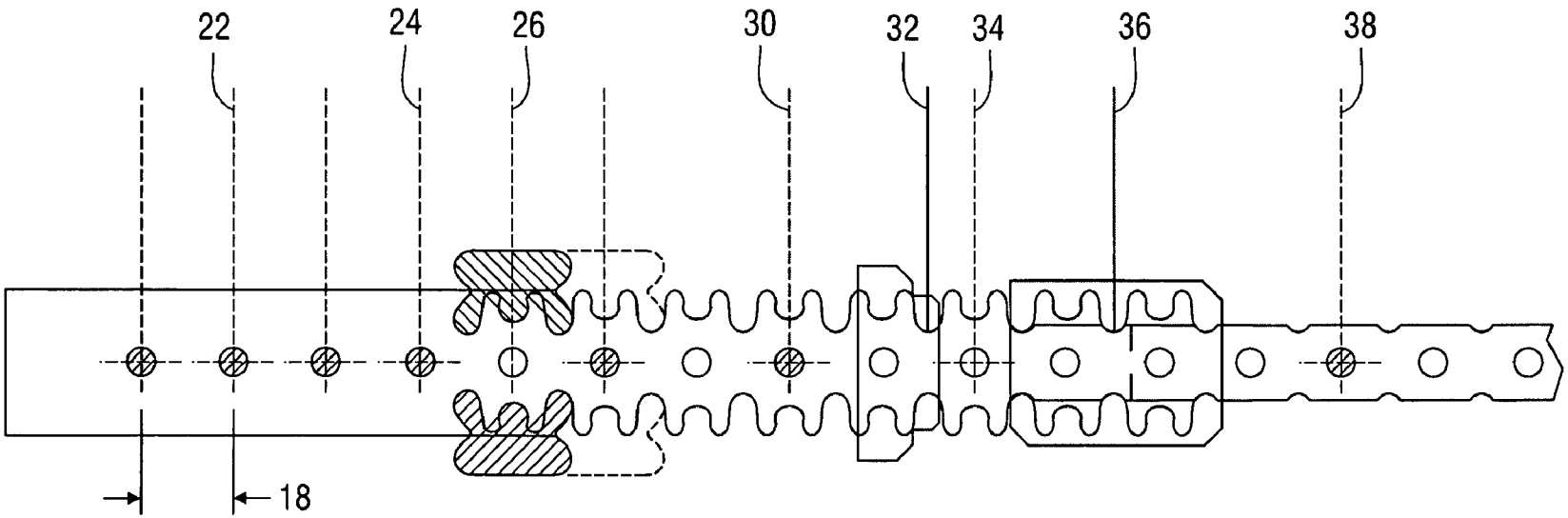
FIG. 2A is a top plan view of a portion of the progressive die stock strip shown in FIG. 1, which shows the band trim stations.
Figure 2B:
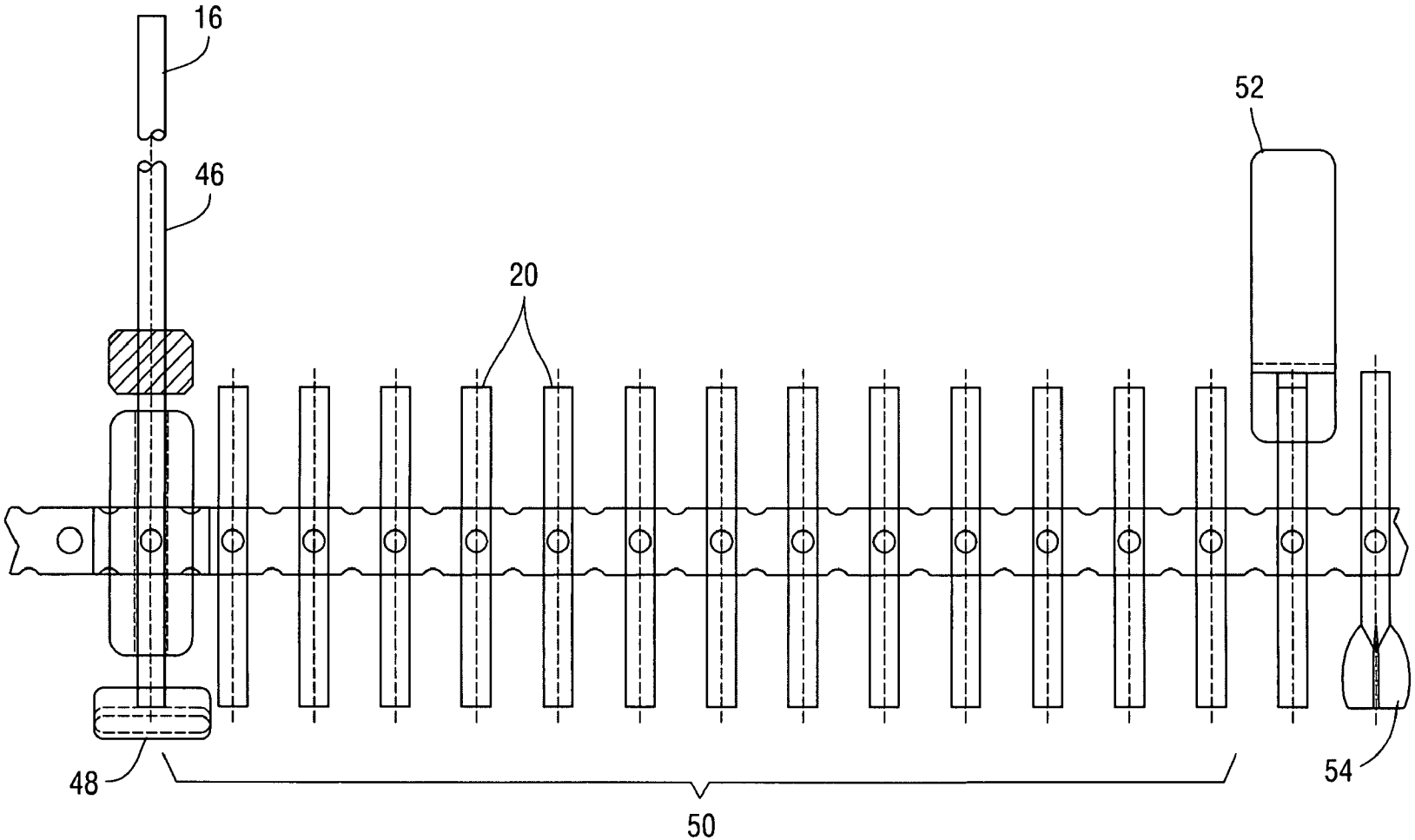
FIG. 2B is a top plan view of a portion of the progressive die stock strip shown in FIG. 1, which shows the wire feed and trim stations.
Figure 2C:
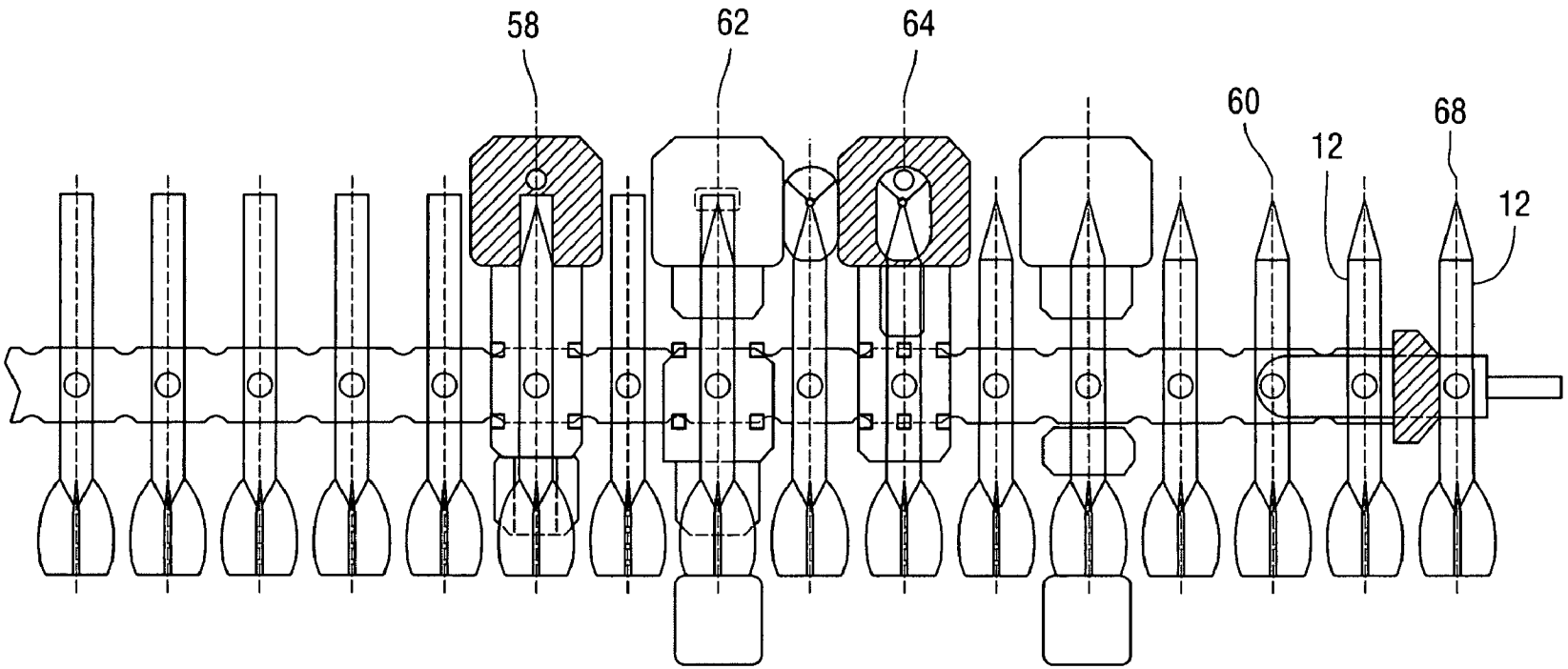
FIG. 2C is a top plan view of a portion of the progressive die stock strip shown in FIG. 1, which shows the tip coining stations.
Figure 3:
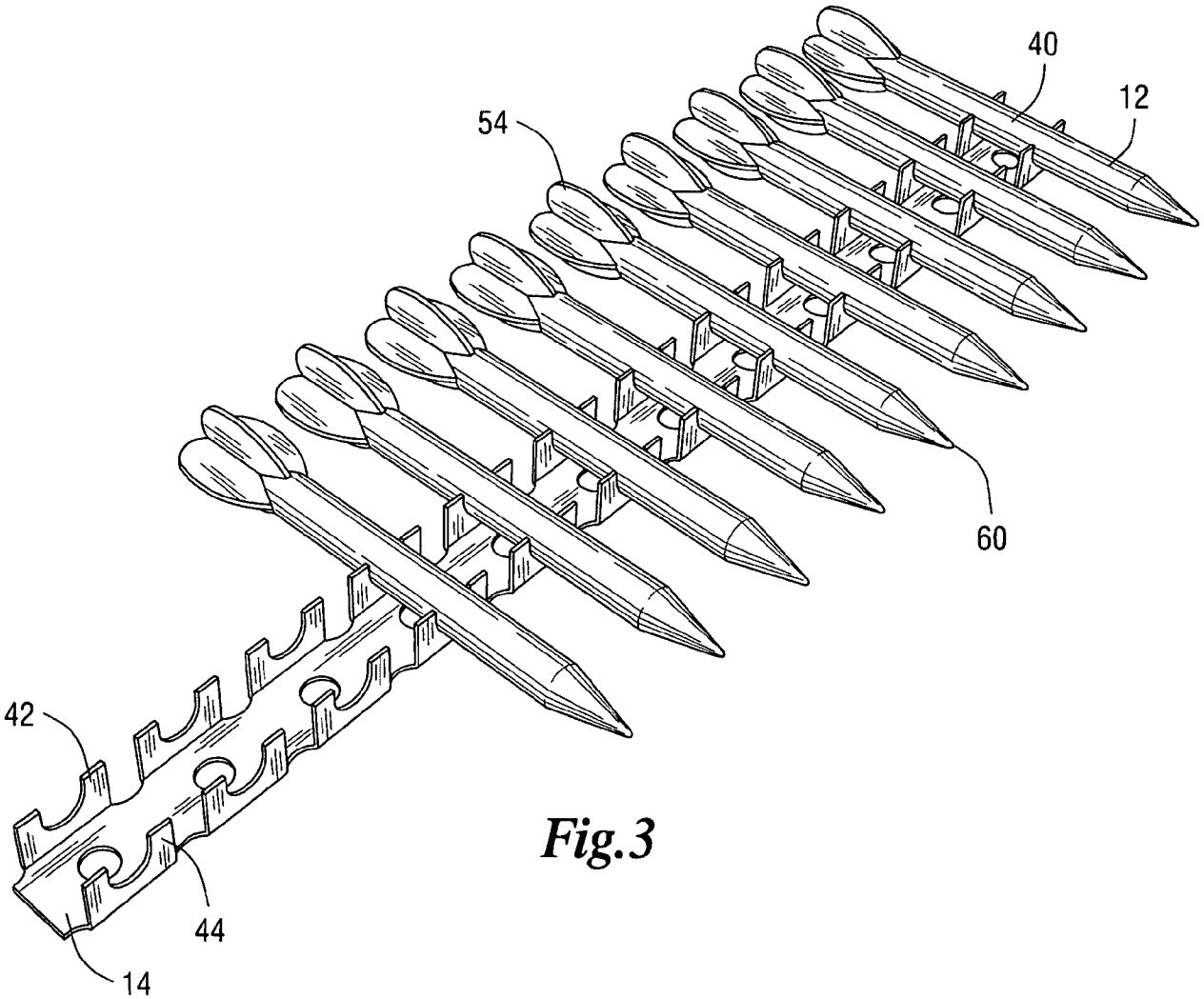
FIG. 3 is a perspective view of a portion of completed bandoliered flechettes.
Figure 4:
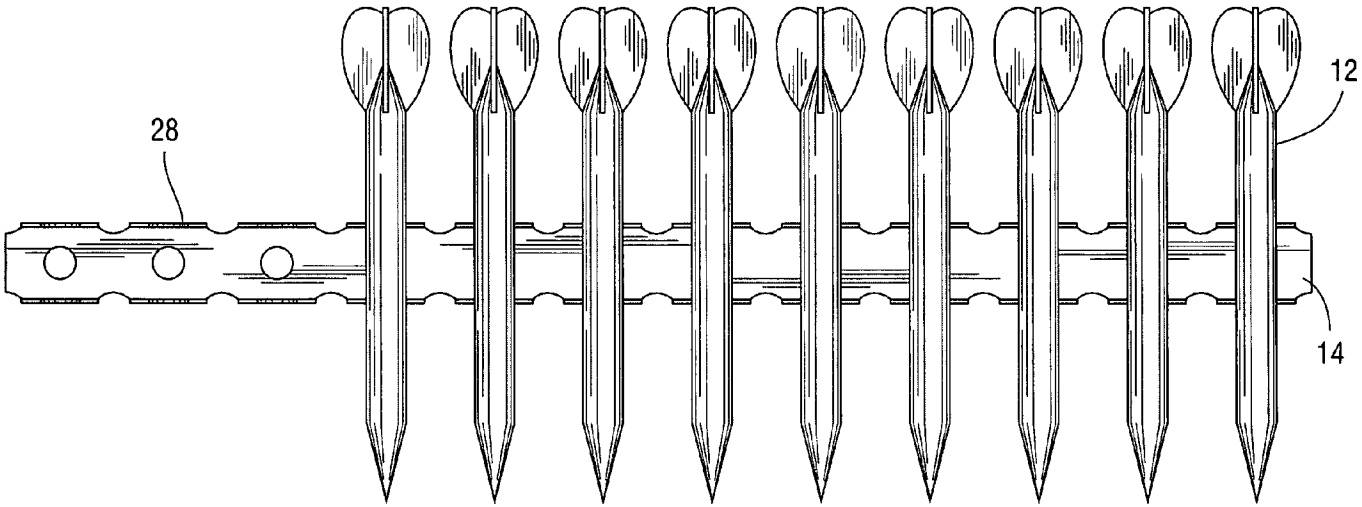
FIG. 4 is a top plan view of the section of completed bandoliered flechettes shown in FIG. 3.
Figure 5:
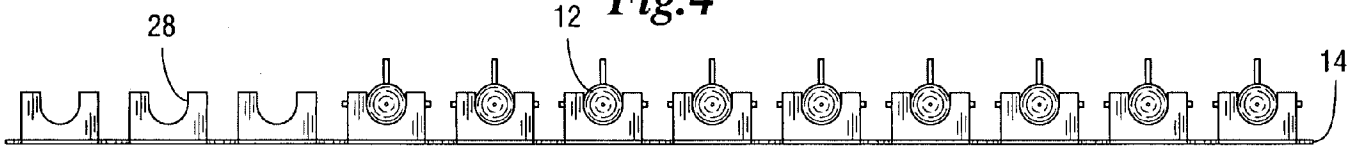
FIG. 5 is a side elevation view of the section of completed bandoliered flechettes shown in FIG. 3.
Figure 6:
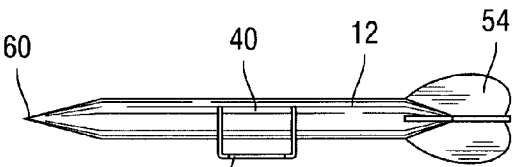
FIG. 6 is a side elevation view of a formed flechette being retained by a retaining member.
Figure 7:
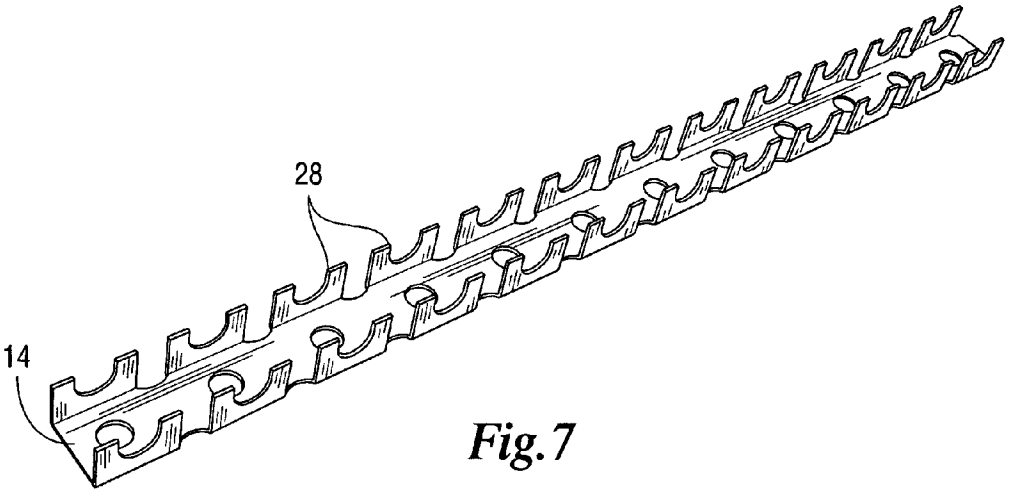
FIG. 7 is a perspective view of the bandolier section shown in FIG. 3.
Figure 8:
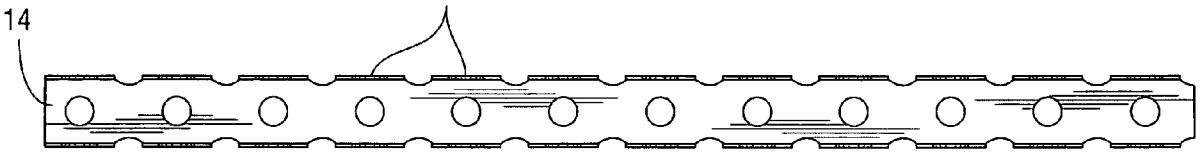
FIG. 8 is a top plan view of the bandolier section shown in FIG. 7.
Figure 9:
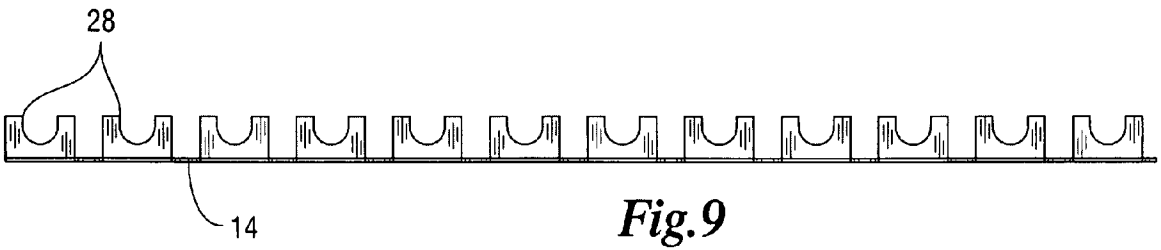
FIG. 9 is a side elevation view of the bandolier section shown in FIG. 7.
Figure 10:
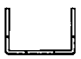
FIG. 10 is a front elevation view of the bandolier section shown in FIG. 7.

FIG. 1 shows a progressive die stock strip 10 used in the method for manufacturing bandoliered flechettes 12. Stock strip 10 is driven through a progressive die through a number of stations. The die itself is not shown. However, those of ordinary skill in the art can easily construct the die and associated drive and tooling elements without undue experimentation. The process begins with the feeding of strip material 14 and wire material 16 into the die. Strip material 14 can be 1008 carbon steel, and wire material 16 can be 1065 carbon steel. The increment 18 of feed for the strip 14 is the "progression" and is commonly 0.500 inch, in which case one wire segment 20 would progress through the various stations at a time. Optionally, the progression can be 1.0-inch. A 1.0-inch progression is used to make two flechettes at a time (commonly referred to as a "2-up" die). In the case of a "2-up" die, the strip would be fed in 1.0-inch increments, and two wire segments would progress through the various die stations simultaneously. However, for the sake of simplification, the 0.500-inch feed progression (commonly referred to as a "1-up" die) will be discussed herein. The feed progression will therefore advance 0.500 inch with each stroke of the die. The die runs at a speed of 150 to 200 strokes per minute (spm).

In FIG. 1, after the strip 14 has entered the die, the first operation is to trim a pilot pierce in strip 14, which involves producing a guide or alignment hole 22 using a pierce punch that is mounted in the top portion of the die set (not shown). As the strip 14 progresses, a pilot (not shown) consisting of a cylindrical alignment rod, is passed through the pilot hole 22 at 24 to ensure proper strip alignment and progression location. Then, the strip 14 progresses through a trim operation 26 that creates the configuration that will eventually become the retention members 28 for retaining the flechettes 12 through the process. The formed retention members 28 can be seen in FIGS. 7 through 10.

The next step is, as is known in the art, to perform another pilot step at 30 in which alignment and proper progression of strip 14 is ensured. This piloting step is referred to as a misfeed pilot. The next step is a camber adjustment 32, which entails mechanically adjusting the strip 14 to ensure that there is no incorrect twist inherent in the strip 14. This step is followed by another pilot step at 34, again for alignment and assurance of proper progression.

The next step entails forming, by bending, the configuration of the retention member 28 upward so that it is essentially perpendicular to the original plane of the strip 14. This is referred to as "U-up" 36. This step is followed by another pilot operation at 38 for the same purpose as previously mentioned. The retention members 28 each have a fork-shaped geometry comprised by forked members 42 and 44, between which the shaft 40 of the flechette 12 is inserted and restrained. The retention members 28 maintain the orientation of the flechettes 12 until the flechettes are mechanically removed from the retention features, using any known technique.

The next processing step involves feeding 1.900 inch of wire 16 into the die, and into a retention member 28. This is referred to as the wire insertion and occurs at 46. A stop 48 at the end of the insertion station 46 locates the end position of the wire 16. The wire 16 is cut, or segmented, into a segment 20, and advanced forward slightly to allow for feeding at this station 46. Throughout the forming process, a slight amount of growth is realized at various stations as shown in FIG. 1. After segmenting the wire 16 into a segment 20, the strip 14 will progress and wire insertion and segmenting will be repeated at the wire insertion station 46 as long as the die is running.

The segmented wire sections 20 continue to advance for an additional 13 feed progressions through section 50 without undergoing any additional forming. Section 50, and other regions of die real estate for which no forming is performed, is often due to the fact that allowance is being made for future changes or additions, or due to the fact that forming tools and equipment require a certain amount of space. Upon the wire segments 20 reaching the $14^{th}$ station 52 after the wire insertion station 46, forming of the fin 54 of flechette 12 occurs via simultaneous cold forming caused by die tooling.

The $10^{th}$ station 56 after the flechette fins 54 are formed, a pre trim station 58 serves as a cutting operation for the initial shaping of the flechette tip 60. Two stations later at 62, the tip forming operation is performed to form a tip pre-coin. Two stations later at 64, another cutting operation occurs to trim the tip 60. Then, two stations later at 66 the final tip formation step is performed, which results in the formation of the final tip 60.

Upon completion of final tip formation step 64, the complete bandoliered flechette has been formed. At this point the completed flechettes 12 can be removed from the retention member 28 to form a loose pieced flechette. Alternately, the flechette 12 can be maintained in the bandoliered state by wrapping the bandolier onto a reel using well known reeling equipment that is used in conjunction with stamping presses. Loose piecing is accomplished by any suitable, known means that applies a small force to the flechette in a direction that is directed away from the bandolier. If it is desired to loose piece the flechette upon formation, this can be accomplished at the last station 68 of the die 10 by holding the flechette with two pads (not shown) in the die 10, and then cutting away the strip 14 in ½ inch increments. The strip 14 is considered scrap, and the completely formed flechette 12 is blown out of the die 10 using a source of air into a container.

Figure 11:
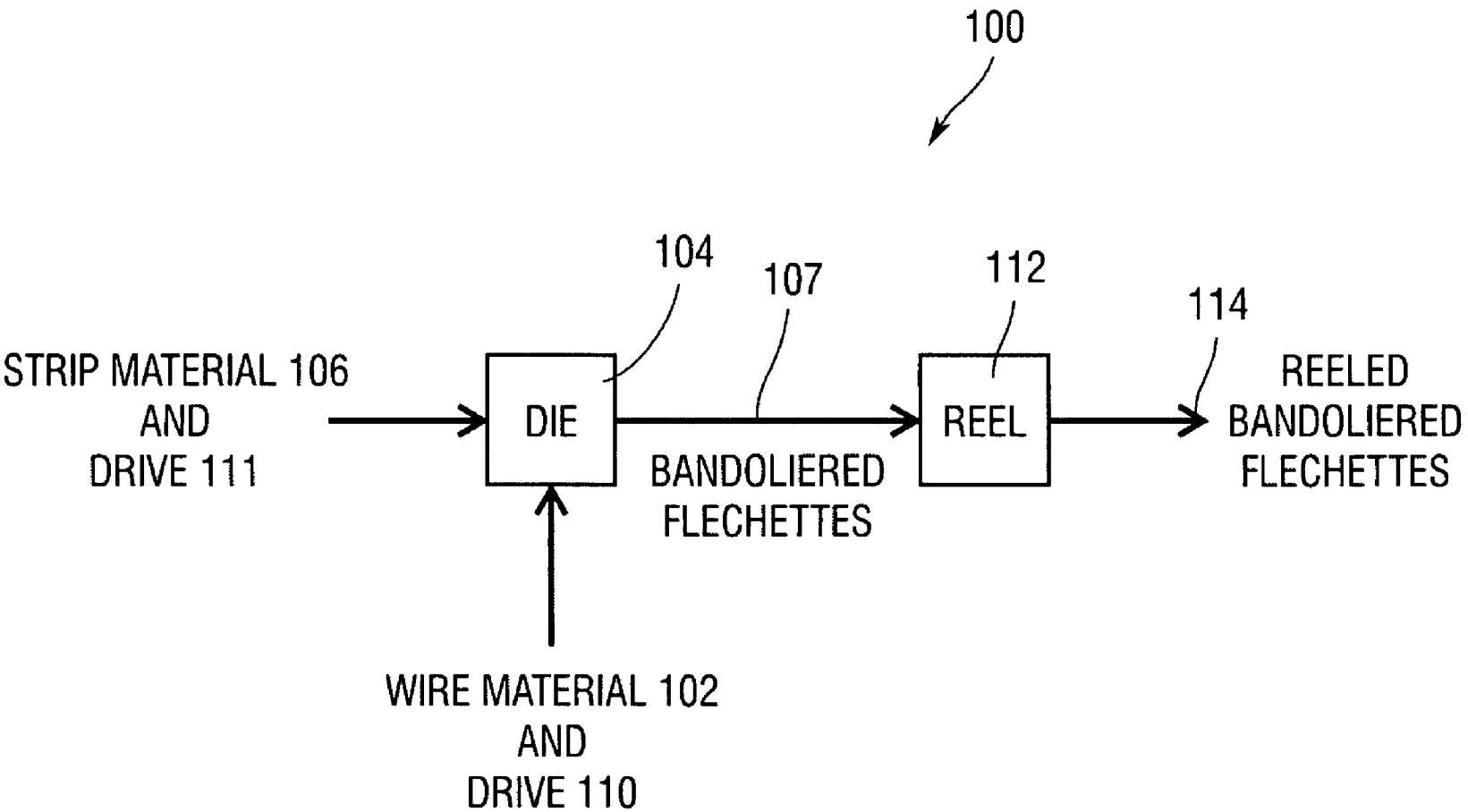
FIG. 11 is a block diagram of a system 100 for producing bandoliered flechettes on a reel.

FIG. 11 shows a system 100 that can be used to produce bandoliered flechettes on a reel. Wire material 102 and strip material 106 are fed to die 104, which produces bandoliered flechettes 108 in accordance with the description herein. Bandolier drive 111 is used to drive the strip material 106 through the die 104, and drive 110 is used to drive the wire material 102 to station 46 of die 104. A reel 112 reels the bandoliered flechettes onto a reel at 114. System 100 can be used anytime further operations need to be performed on the bandoliered flechettes 107, but when it is not desired or possible to feed the bandoliered flechettes to those operations. For example, it may be desired to store bandoliered flechettes in reel form prior to heat treating or other operations.

Figure 12:
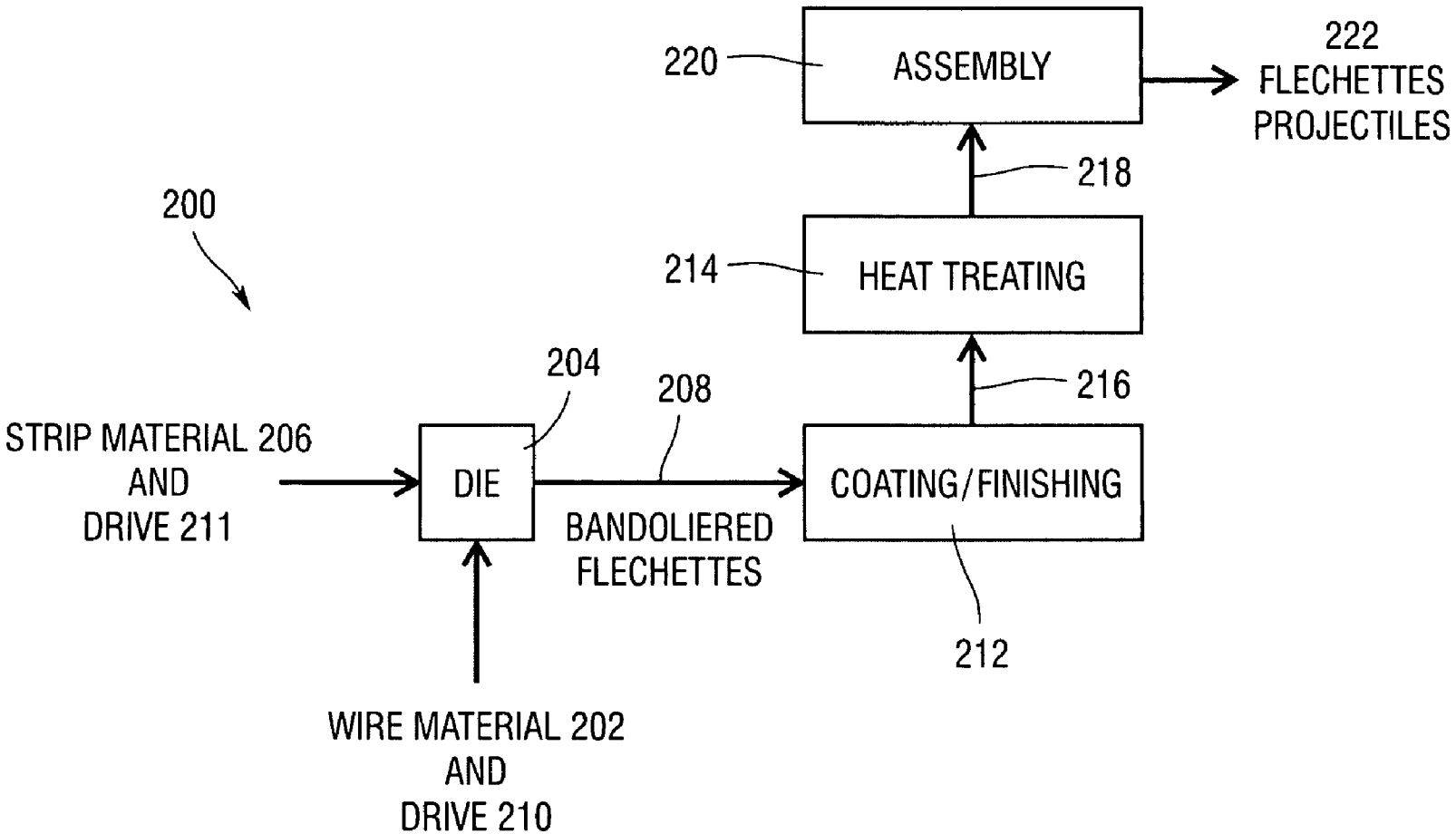
FIG. 12 is a block diagram of a system 200 for producing bandoliered flechettes and performing post-forming operations on the flechettes

FIG. 12 shows a system 200 that can be used to produce bandoliered flechettes that are conveyed directly to stations at which post-forming operations are performed on the flechettes. As with system 100, bandolier drive 211 is used to drive the strip material 206 through the die 204, and drive 210 is used to drive the wire material 202 to station 46 of die 204. Die 204 produces bandoliered flechettes 208 in accordance with the description herein. Bandoliered flechettes 208 are then fed to coating/finishing station 212 where they are coated and finished as is desired and known in the art. The coated bandoliered flechettes 216 are then fed to heat treating station 214, where they are heat treated. The heat treated bandoliered flechettes 218 are then fed to assembly station 220 where they are removed from the retention members 28, and assembled into the cylindrical shells to produce the flechette projectiles 222. It is to be understood that any, all or none of the post-forming operations may be performed for a given application, as is known in the art. It is also to be understood that, rather than conveying bandoliered flechettes 208 directly to the post-forming operations, a system like that shown in FIG. 11 can be used to form bandoliered flechettes 208 into a reel and stored. When the reeled flechettes 208 are ready for post-forming operations, the reel can be conveyed to the post-forming operations, and unreeled in to the post-forming stations.

What is claimed is:

1. A method of making bandoliered flechettes using a progressive die, comprising the steps of:

feeding metal strip material into said progressive die;

feeding metal wire material into said die;

using said die to form said strip material into a bandolier comprising a base supporting a plurality of retaining members spaced along said base;

using said die to form said wire material into loose-pieced flechettes, each of which is releasably retained by a said retaining member.

2. The method recited by claim 1 further including the step of segmenting said wire material to form wire segments, and each said flechette is formed from a said wire segment.

3. The method recited by claim 2 wherein the fins of each flechette are formed before the said wire segment is cut from which said flechette is formed.

4. The method recited by claim 2 wherein the fins of each flechette are formed after the said wire segment is cut from which said flechette is formed.

5. A method for manufacturing flechettes using a progressive bandolier die, said die comprising a bandolier having retaining members engaged with flechettes during forming operations within the progressive die, the retaining member including a retaining portion to releasably retain the flechette to the bandolier.

6. A method for conveying flechettes through a progressive die from an origination point to a destination point along a predetermined path in a flechette forming process, said method comprising the steps of:

forming flechettes from wire material;

as said flechettes are being formed, progressively forming a bandolier from strip material, said bandolier including a base that supports a plurality of retaining members spaced along said base;

inserting each said flechette into a said retaining member as said flechette is formed to form bandoliered flechettes;

using said bandolier to convey said flechettes through said progressive die, using a drive to convey said bandolier through said die; and reeling said bandoliered flechettes onto a reel.

7. The method recited by claim 6 further comprising the step of conveying said bandolier to a cleaning station to clean said flechettes.

8. The method recited by claim 6 further comprising the step of conveying said bandolier to a coating and finishing station.

9. The method recited by claim 6 further comprising the step of conveying said bandolier to a heat-treating station.

10. The method recited by claim 6 further comprising the step of conveying said bandolier to an assembly station.

11. A process of manufacturing flechettes comprising the steps of forming bandoliered flechettes, passing the bandoliered flechettes through desired post-forming operations, and releasing the flechettes from the bandolier.

* * * * *